US006135885A

United States Patent [19]

Lermusiaux

[11] Patent Number: 6,135,885

[45] Date of Patent: Oct. 24, 2000

[54] ELECTRONIC FOOTBALL WAGERING GAME

[76] Inventor: Lawrence E. Lermusiaux, 6240 Duneville St., Las Vegas, Nev. 89118

[21] Appl. No.: 09/034,859

[22] Filed: Mar. 4, 1998

[51] Int. Cl.[7] ..... A63B 67/00

[52] U.S. Cl. ..... 463/20; 463/16; 463/4

[58] Field of Search ..... 463/16, 17, 18, 463/19, 20, 4; 273/143 R, 138.2, 274

[56] References Cited

U.S. PATENT DOCUMENTS 5,560,603 10/1996 Seelig et al. ..... 463/20
5,664,998 9/1997 Seelig et al. ..... 463/20
5,769,714 6/1998 Wiener et al. ..... 463/3
5,779,544 7/1998 Seelig et al. ..... 463/20
5,957,775 9/1999 Cherry ..... 463/16
5,997,400 10/1999 Seelig et al. ..... 463/20
6,007,427 12/1999 Wiener et al. ..... 463/17

*Primary Examiner*—Jessica J. Harrison
*Attorney, Agent, or Firm*—Qurik & Tratos

[57] ABSTRACT

A method for player to play a wagering game is set forth based upon sports games such as football. The player makes a wager and defensive and offensive formations are selected and displayed. The play is run and based upon the outcome obtained the player either wins or loses their wager. The method includes providing the player with an opportunity to double their wager. As a further embodiment, the game may be used as a method for providing a bonus for a base game.

9 Claims, 3 Drawing Sheets

ELECTRONIC FOOTBALL WAGERING GAME

FIELD OF THE INVENTION

The present invention relates to electronic wagering games such as slot machines and more particularly electronic games which provide for wagering upon simulated play of a football play.

BACKGROUND OF THE INVENTION

In casinos, slot machines, video poker and video keno machines have widely been played for fun and enjoyment by the public. As is well known, players make a wager, which can be by tokens or monetary coins such as quarters, and thereafter play the machine to obtain an outcome. Based upon the outcome, the player either wins or loses, and if the outcome is a winning outcome, the player is rewarded. The reward for any winning outcome is based upon the frequency of that outcome occurring versus other winning outcomes and losing outcomes. The payoff, or reward, times the outcome frequency defines a payoff frequency for that outcome. The sum of all payoff frequencies for all winning outcomes versus the total of all outcome frequencies, both winning and losing, should provide the casino with a profit (sometimes referred to as the hold) which makes providing the game profitable to the casino.

Some current slot machines provide players with the opportunity to make choices. One such machine which is quite popular is a video poker machine. As is well known, these machines include a data processor which randomly selects an opening hand of five cards from a data structure containing data of the 52 cards of a deck of cards (or 53 cards for Joker's wild video poker machines). The player opts to discard some or all of the cards of the opening hand for which replacements are dealt from the data structure. Depending upon the final constructed hand the player either loses or is rewarded. Payoff frequencies for these machines are such as to provide the machine with typically approximately a three per cent hold. This hold can be adjusted by adjusting the payoff for one or more outcomes since statistically the outcomes, e.g. four-of-a-kind, will occur based upon the constituency of the data representing the cards of the deck, and a particular frequency from that data that a four-of-a-kind will be obtained.

Heretofore unrelated to slot and video poker machine technology is sports wagering. From a dollar amount, wagering upon sporting events represents the greatest volume of betting in the United States. Of sports betting, wagering upon the game of American football constitutes the largest percentage of sports wagering. In casinos at least in Nevada, wagering is permitted relating to actual games being or to be played. However there is no game which provides players with wagering opportunities and decisions related to a generated simulation or presentation of plays of a fictitious football game. It is believed that a large segment of players who have an interest in football wagering would be drawn to such games and play the same. This would provide an advantage to the casino since football fans could bet football with a machine year round since the same is not tied to nor related to the actual play of a game. Further such action could take place without the need to provide personnel such as staff to book sports wagers since the machine functions autonomously. Still further players in those jurisdiction which do not permit sports wagering could wager upon such a game.

SUMMARY OF THE INVENTION

There is, therefore, set forth according to the present invention a method and device for playing a wagering game related to the game of American football which provides the player with decision making capabilities, which can be adapted to generate either simulated or previously recorded actual play outcomes and which provides the player with an opportunity to obtain a reward several times their initial wager.

Toward this end the method according to the present invention includes providing a processor including (i) an offense data structure containing data representing at least one and preferably a plurality of football offensive player formations and (ii) a play data structure which includes data representing both winning and losing play outcomes for a play. To play the game the player makes a wager which may be monetary units, tokens or fictitious credits and initiates play of the game. Upon wagering and initiation, the processor displays at a display a representation of a football playing field and representations of defensive players aligned in a defensive formation along a line of scrimmage. The line of scrimmage may be fixed from play to play or may be randomly selected. The player's offensive formation is also displayed aligned at the line of scrimmage in opposition to the defensive formation. Where a plurality of offensive player formations are provided in the data structure, the player of the game selects the offensive play formation, e.g. run, pass, field goal. Thereafter the player prompts the processor to run the play. When so prompted the processor randomly selects from the outcome data structure, based upon the defensive and offensive formation, a play outcome and displays the running of the play. The display may create a simulated running of the play outcome or may display running of an actual, previously recorded and stored running of the play by actual players. Sound may be included to enhance the excitement of the running of the play. Winning plays are defined by the outcome of the play such as the player obtaining a first down (a play which results in a gain of ten or more yards from the line of scrimmage), a touchdown, field goal or the like. The outcomes of the outcome data structure are preferably statistically weighted such that the payoff frequency for the outcome is as desired, preferably comparable to that of existing slot machines. Higher rewards may be provided for less frequent outcomes such as touchdowns and field goals from fifty or more yards. Losing outcomes would be defined by lesser outcomes such as an interception, fumble, quarterback sack or modest running play gain. Where a winning outcome is selected the player is rewarded for obtaining that outcome.

In another embodiment, if the player obtains a losing outcome, they may double their wager and in essence play a second down from the line of scrimmage obtained by the prior outcome. For example, if the first play obtained a gain of nine yards the player may opt to double their wager whereupon the processor displays the defensive formation at the second down line of scrimmage. The player of the game, if available, selects the offensive play formation which is likewise displayed at the second down line of scrimmage. Upon prompting the processor, a second outcome is selected from the data structure and the running of the play is displayed. Depending upon the outcome, the player either loses both their original and doubling wager or is rewarded.

To provide for a greater number of outcomes and the ability to offer larger jackpots for certain outcomes, the processor may include a field position data structure and a defensive formation data structure. Upon initiation of play the processor randomly selects field position and the defensive formation for display. Because of the random selection of field position, defensive formation and outcome, the probabilities for obtaining certain outcomes, e.g. a touchdown of greater than fifty yards, can be reduced and the payoff therefor increased to define a jackpot.

The device according to the present invention includes a processor including the aforementioned data structures, means for the device to accept a wager and to initiate play of the game. Where provided, the device also includes means for the player to select the offensive play formation. A display displays the formations. Said processor is adapted to, from the defensive and offensive alignments, randomly select an outcome. If the outcome is a winning outcome, the device include means for rewarding the player.

The game and method may be played as a stand alone game or may be an adjunct to a slot machine. According to this embodiment, the player would play a traditional a reel-type slot machine. The player makes a desired wager and initiates a spin which presents rotating reels which eventually stop to present symbols along a pay line defining an outcome for the game. Depending upon the outcome the player either loses their wager or is rewarded. Depending upon the outcome, the player is presented with the game and method according to the present invention as by providing a separate video display or by, if the slot machine has a video display, changing the video presentation. Upon this occurrence, the game presents at least a portion of a football field and randomly selects a defensive and offensive alignment and outcome from the running of a football play from that alignment. Again the running of the play can be computer generated or the game can access a library of actual plays from a data storage device such as a compact disk. Depending upon the outcome, the player is rewarded a certain amount.

As can be appreciated, the method and device of the present invention provides the player with the excitement associated with the play of football. Further jackpots for certain outcomes can be provided. In the preferred embodiment, the game also offers the player with choice opportunities of selecting the offensive play formation and whether to double to better their previous losing outcome.

BRIEF DESCRIPTION OF THE DRAWINGS

These and other features and advantages we become better appreciated as the same becomes better understood with reference to the description, claims and drawings wherein:

DESCRIPTION

Figure 1:
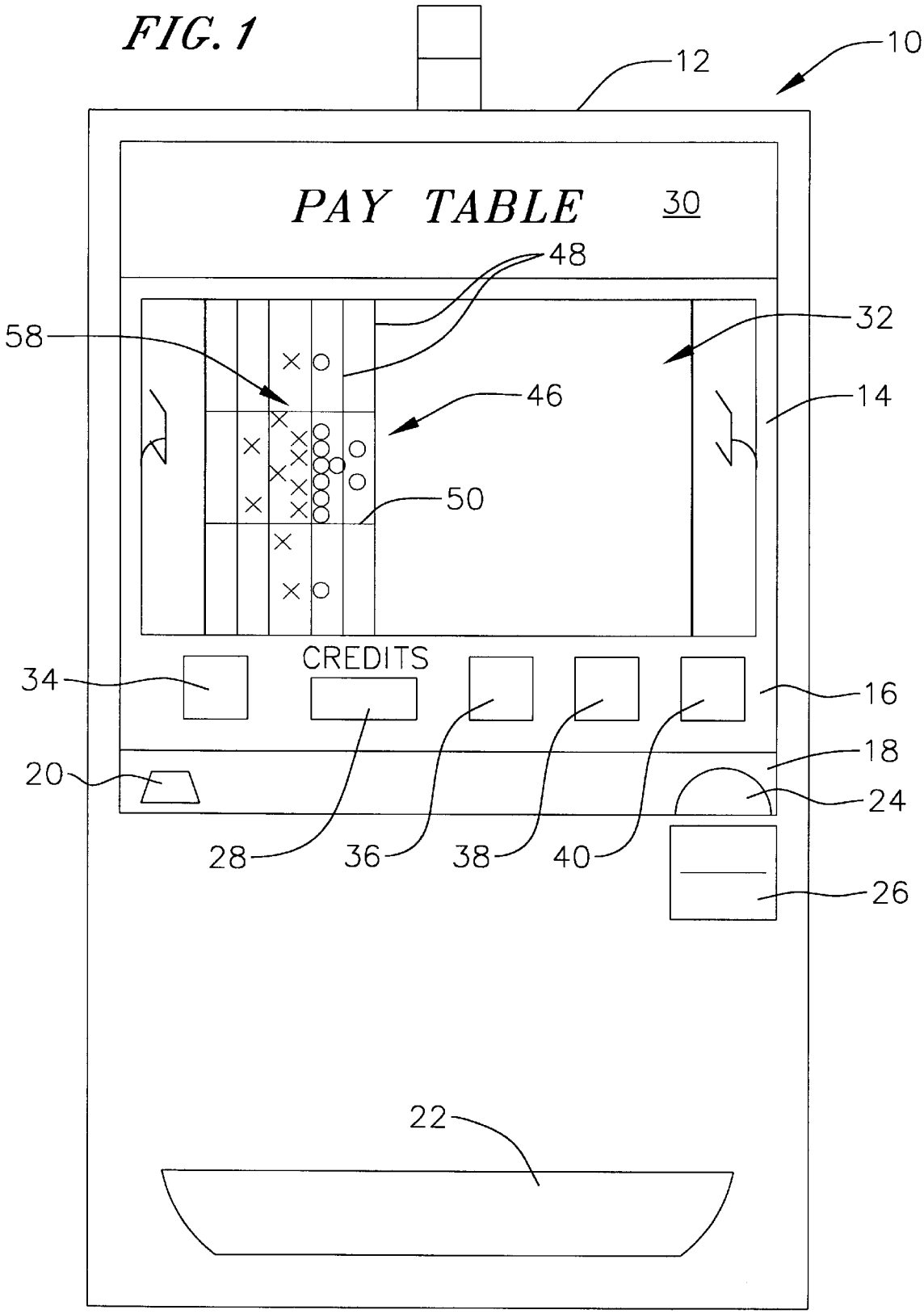
FIG. 1 shows a front view of an electronic device according to and incorporating the method of the present invention.

Turning to the drawings, FIG. 1 shows a device, illustrated as a gaming machine 10, incorporating the game and method according to the present invention. While the machine 10 is shown as a upstanding type of machine, it is to be understood that it could also be of the type installed on a flat surface such as a bar top or the like.

The machine 10 includes a cabinet 12 which houses a data processor (not shown) such as a mini-computer of the type presently controlling electronic slot machines such as video poker, keno and the like. Disposed on the cabinet 12 is a video display 14 also of known construction. To present the game according to the method of the present invention, preferably at least a portion of the display 14 is a touch screen 16 by which a player can input data and control the play of the game as hereinafter described.

The cabinet 12 includes below the display 14 a panel 18 which may project from the front of the cabinet 12 and mount one or more action buttons. If the touch screen 16 is provided, the panel 18 may only include a cash out button 20 which, if depressed, prompts the machine 10 to dispense any accumulated winnings retained by the machine 10 into a tray 22. Also disposed on the panel 18 is a coin slot 24 adapted to receive coins or tokens for placing wagers with the machine 10 in the manner hereinafter described. The machine 10 may also include a bill changer 26 of known construction adapted to receive paper currency and accumulate credits, based upon the denomination of the currency available, for play of the game. The amount of accumulated credits is displayed at display 14 in a credit window 28. For example, and as is well known, if the machine 10 accepts wagers in 25 cent denominations, inserting a $20 bill at the bill changer 26 will accumulate 80 credits displayed at the credit window 28.

The display 14 also is adapted to display a pay table 30 providing information to the player of the pay outs available during play of the game and the pay out being issued for any obtained winning combination. Below the pay table 30 is an action area 32 which presents the action of the game as hereinafter described for play by the player.

With continuing reference to FIG. 1, the display 14 also shows at the touch screen 16 various locations or buttons for controlling the play of the game. For example, the display may show a bet 1 button 34 which, if touched by the player, prompts the processor to wager one accumulated credit for play of the game. Also shown is a select offense button 36 by which the player, in the manner described above, will select the football offensive formation to be played in an attempt to obtain a winning outcome. By touching the select offense button 36, the player can scroll through and select the desired offensive formation. Adjacent the select offense button 36 is a max wager button 38 which, if depressed by the player, wagers from the accumulated credits displayed in the credit window 28, the maximum number of credits for each play of the game. For example, if the machine 10 can accept a maximum wager of five coins, the player by touching the max wager button 38 wagers five coins or credits and further initiates the play of the game as hereinafter described. The display 14 also displays at the touch screen 16 a play button 40 by which, in the manner described below, the player can initiate the play of the game if he/she has not wagered the maximum amount and by which the player completes the play of the game.

As hereinafter described, the select offense button 36 and max wager button 38 also function to enable the player to double their wager in the play of another embodiment of the game.

Figure 2:
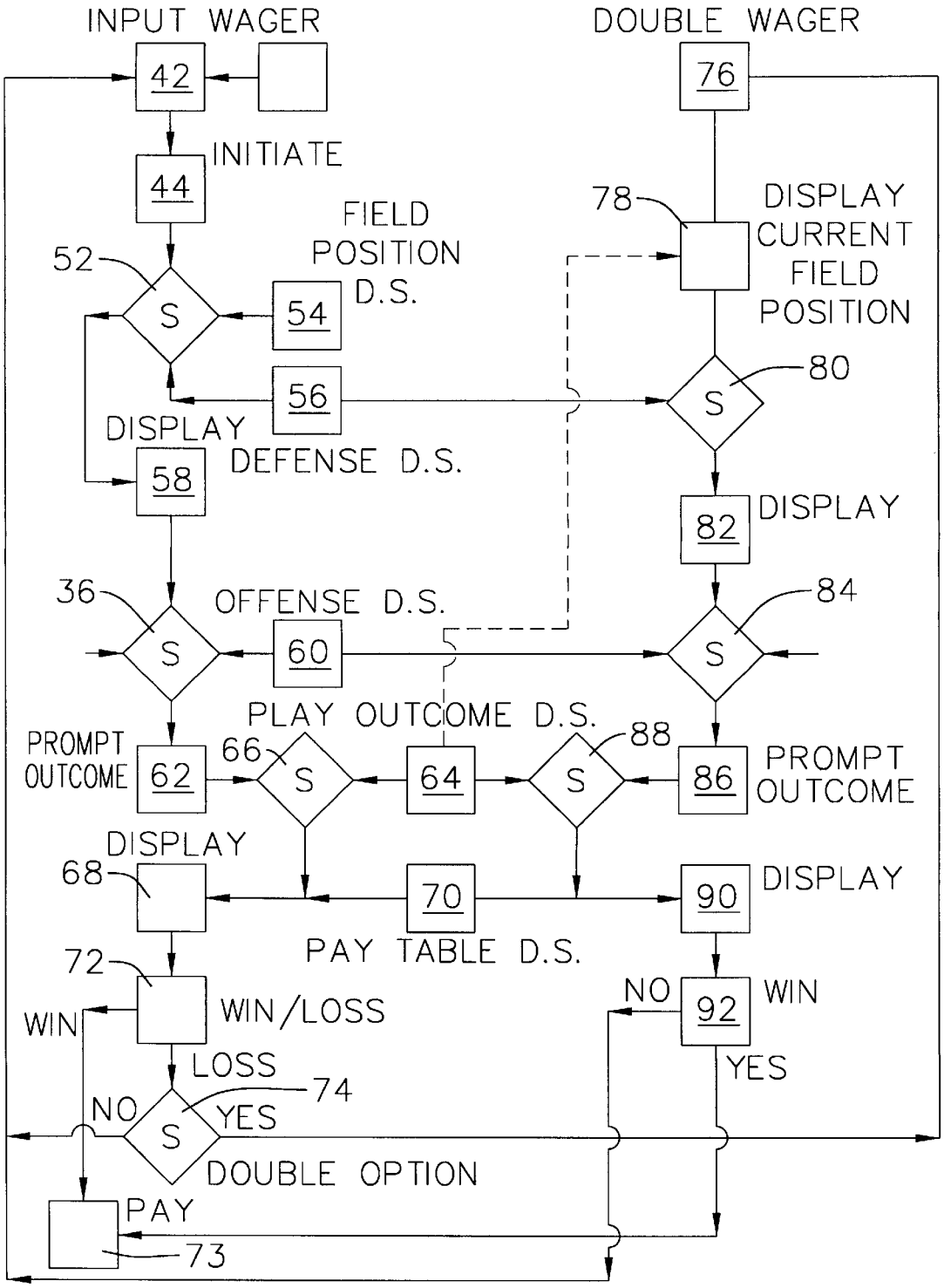
FIG. 2 shows a logic diagram for the method of the present invention.

With the components of the machine 10 described above, the play of the game will now be described with reference to those components. With reference to FIGS. 1 and 2, the player initiates play of the game by inputting a wager at 42. Prior to inputting the wager, the processor for the machine 10 may drive the display 14 to display a standby presentation which may explain how to play the game, sample plays of the game or other information to entice players to play the game. To input a wager, the player either inserts coins or tokens into the coin slot 24 or inputs paper currency into the bill changer 26 to accumulate credits. From the accumulated credits, the player touches the touch screen 16 at the bet 1 button 34 to wager less than the maximum amount or touches the max wager button area 38 to make a maximum wager. If the player has made a maximum wager, the device is immediately initiated at 44 whereby the processor drives the display 14 to display a simulated American football field layout 46 or a portion thereof. Preferably, the display of the layout 46 includes at least one end zone with goal post and the grid including yardage markers 48 and hash marks 50. At 52, and upon initiation of the play of the game at 44, the processor randomly selects from a field position data structure 54 the field position for the play of the game. The field position data structure 54 includes data representing a plurality of starting field positions for the play of the game. The starting field positions may be weighted such as in a bell curve fashion, with an average starting field position at or about the defensive teams 30 yard line. The processor also includes a defensive formation data structure 56 including data representing at least one but preferably a plurality of defensive formations. For example, the defensive formation data structure 56 may include defensive formations as are well known in the game of football such as the 3–4, prevent defense, 4–3 or the like. The defensive formation data structure 56 may also include associated with one or more of the defensive formations, a blitz package which is adapted, as is well known in the game of football, to upon initiation of the play send one or more of linebackers or defensive backs to attack the offensive team's quarterback. Accordingly, it is to be understood that the defensive formation data structure 56 may include a plurality of defenses which are randomly selected. The defensive formation data structure may be weighted statistically in a bell curve fashion to make selection of the more common 4–3 defense the most statistically selected defense to be presented.

Upon random selection of the field position and defensive formation, the processor drives the display 14 to display the starting field position and defensive formation as is shown in FIG. 1 and in FIG. 2 at 58. At this point, the player using the select offense button 36, selects the offense he/she desires to play against the random selected defense. In the most rudimentary version of the game according to the present invention, the offense is standard and the player may have no selection as to the offense to run but may be able to select either a run a pass or field goal. According to the preferred embodiment, upon display of the field position and defensive formation at 58, the player is given the opportunity to scroll through and select any one of a plurality of offensive formations stored in an offense formation data structure 60. Viewing the field position and the defensive alignment, and knowing the payoffs as provided by the pay table 30 and as described below, the player selects the desired offense. The plurality of offensive formations stored in the offensive formation data structure 60 may include a four wide receiver offense, tight end offense, full house back field offense, split backfield offense, single back offense, and each offense may include a run or pass option.

The offense formation data structure 60 may also include randomly selected prompts to inform the player that a winning outcome is eminent. These prompts may be to the effect that the wide receiver will be open on the next play suggesting to the player to run a pass play. These prompts in essence provide the player with sure winners much like in video poker where the player is dealt a winning outcome, e.g. a four-of-a-kind.

Upon selection of the offense from the offense data structure 60, the offense is displayed at the displayed field position 54 in a position opposing the defensive formation displayed. Thereafter the player, at the play button 40, and as shown in FIG. 2 at 62, prompts the outcome. Upon prompting the play, the processor, randomly selects the outcome based upon the defensive formation and the selected offensive formation. If the player has received an initial "sure thing" prompt, the outcome selected corresponds to the prompt. That is, if the player was prompted that the field goal kicker has a high percentage of successful attempts from this field position and the player selects a field goal offense, the outcome corresponds to a made field goal. Accordingly, a play outcome data structure 64 is provided from which the processor randomly selects, or selects on a weighted basis, the outcome of the play. The outcome may be weighted based upon the selected offense and defensive formations. Upon selection at 66 of the outcome, the outcome is displayed at 68 at the display 14 of the machine 10. The display of the outcome may be by animated, simulation of the play or by retrieving from a suitable data storage device such as a compact disk, actual video images of a live play run under similar circumstances. The selected and displayed outcome is compared to a paytable data structure 70 to determine if the player has obtained a winning outcome. Table 1 below shows selected ones of exemplary winning outcomes and the payoffs provided for each coin wagered. It is to be understood that various other pay off schedules and other outcomes could be provided related to outcomes of play.

TABLE 1

| | |
|---|---|
| Field Goal Over 60 Yards | 200 |
| Touchdown Over 50 Yards | 80 |
| Field Goal 35–59 Yards | 60 |
| Touchdown 40–49 Yards | 50 |
| Touchdown 30–39 Yards | 25 |
| Touchdown 0–29 Yards | 8 |
| 30 Yard Gain | 5 |
| 20–29 Yard Gain | 2 |
| First Down | 1 |

Thus, if the field position randomly selected is at the 35 yard line and the player has wagered five tokens and the outcome is a touchdown, the player would be paid 125 tokens. As stated above, other outcomes could produce higher or lower pay offs depending upon their frequencies of outcomes. For example, a defensive touchdown on an interception could provide a large payoff since it is relatively infrequent. It is to be understood that other propositions could be added to the paytable.

Based upon the outcomes listed above, an 8,000 variations of outcomes available, Table 2 shows an exemplary payoff frequency for the game.

TABLE 2

| PAY BACK PER COIN WAGERED | FREQUENCY PER 8,000 PLAYS | TOTAL PAY BACK PER 8,000 PLAYS |
|---|---|---|
| 1 | 2,000 | 2,000 |
| 2 | 500 | 1,000 |
| 5 | 90 | 450 |
| 8 | 60 | 480 |
| 25 | 25 | 625 |
| 50 | 20 | 1,000 |
| 60 | 15 | 900 |
| 80 | 10 | 800 |
| 200 | 2 | 400 |
| TOTAL | 2732 | 7655 |

The hold of the machine according to the pay out frequency per 8,000 plays is thus 345÷8,000 or 3.0625%.

If the outcome is determined to be a win at 72, the player is paid at 73 according to the paytable. The payoff may be by accumulating credits in the credit window 28 or by dispensing coins into the tray 22. If the outcome is a losing outcome, according to the basic embodiment of the present invention, the game is over and the player must initiate play by inputting a wager. According to a second embodiment, if the outcome is not a winning outcome, the player is giving an option at 74 to double their wager as shown in FIG. 2. This double option may be selected by the display 14 displaying the word "double" with a "yes ?" over the select offense button 36 and a "no ?" over the max wager button 38. If the player selects not to double, play is discontinued and the player is returned to the input wager 42 step to play another game. If the player selects yes, the player doubles their wager at 76 whereupon the processor prompts the display 14 to display at 78 the field position from the previous play temporarily stored in the processor. The processor randomly selects at 80 from the defense data structure and displays at 82 the selected defense at the new line of scrimmage. The player at 84 selects the offense and at 86 prompts the play of the game by depressing the play button 40. As before, the processor selects from the play outcome data structure 64 at 88 the outcome of the play and displays at 90 the same at display 14. The outcome is compared at 92 to the data of the paytable data structure 70 to determine if a winning outcome has been obtained. If the player has obtained a winning outcome, they are awarded at 73 a pay back based upon their initial and doubling wager. If they do not obtain a winning outcome, both the initial and doubling wagers are lost and the player is returned to the start of the game to play another game.

Figure 3:
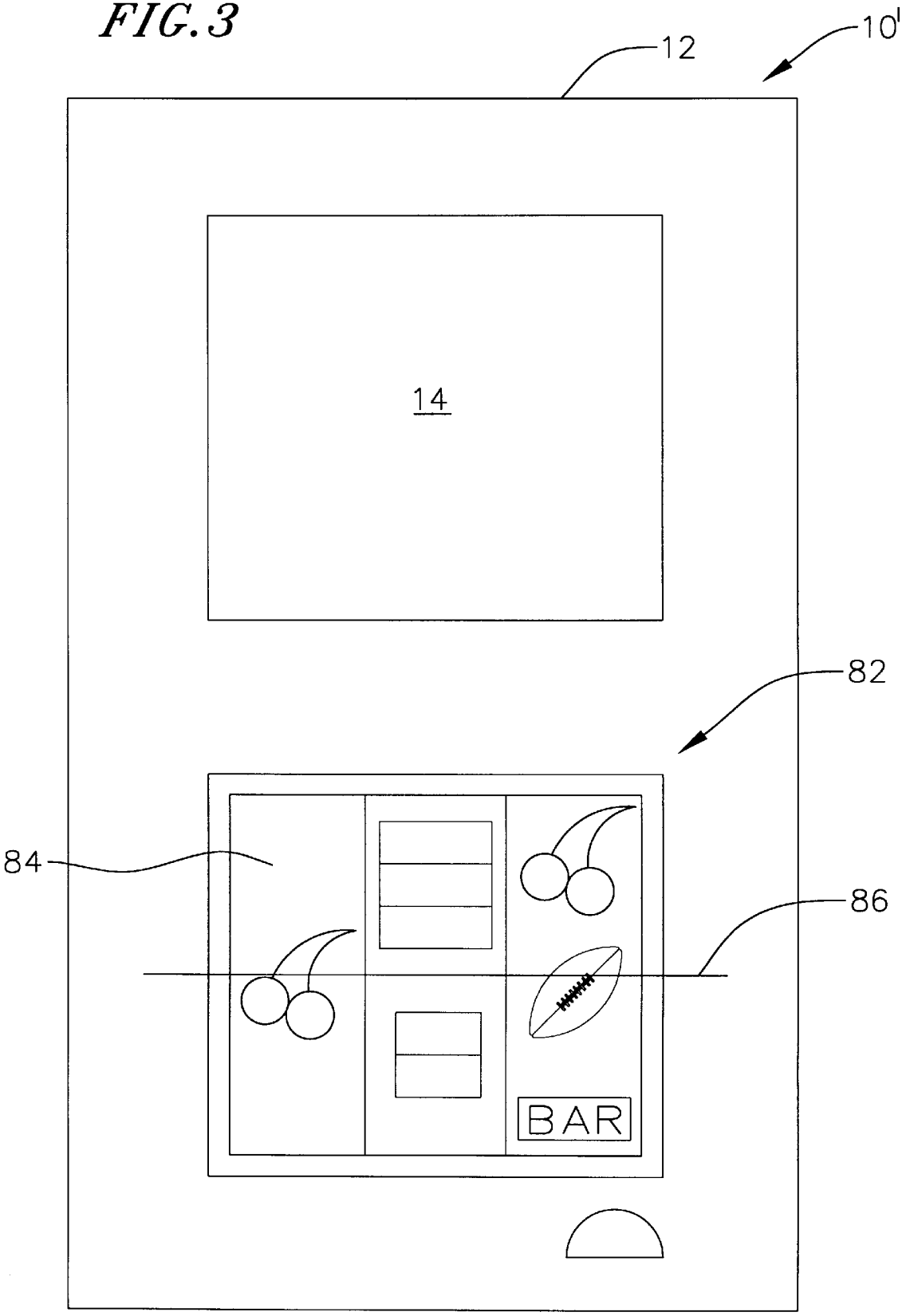
FIG. 3 shows a further embodiment of the present invention.

Turning to FIG. 3 a further embodiment of the game according to the present invention is shown as included in a machine 10'.

The game includes a base game 82 shown as a reel-type slot game. As is known, the base game 82 includes three or more reels 84 having symbols disposed thereon. The player makes a wager and initiates play whereupon the base game 82 spins the reels 84 to ultimately display symbols or blank spaces along a pay line 86 defining the outcome from the base game. Depending upon the outcome the player either wins or loses their wager. If the outcome is a winning outcome the player is paid based upon an established paytable.

According to the present embodiment of the present invention, should the player obtain a predesignated outcome, such as by having a football symbol align at the pay line, a secondary or bonus game according to the present invention is provided. As shown, a display 14 is provided at the machine 10'. When a bonus outcome is obtained, the processor for the game randomly selects and displays from a data storage device such as a compact disk, the running of a sports play to obtain an outcome. For example, where the game is football, the play selected may be a running play where the play gains fifteen yards. If the game is baseball, the play selected may be a base hit. Based upon the play selected and the outcome, the player is awarded a bonus by way of, for example, a payoff or a multiplier applied to the payoff obtained for the base game.

As an alternative to selecting the ultimate play, the game according to the present embodiment may provide for the player to select a running or passing play or the like in the manner described above with reference to the previous embodiment. Thus the processor may select a defense and player select an offense whereupon the processor randomly selects and displays the outcome.

While I have shown and described certain embodiments of the present invention, it is to be understood that it is subject to many modifications and changes without departing from the spirit and scope of the claims set forth herein.

I claim:

1. A method for playing a wagering game of football comprising:

providing a data processor including, (i) a starting field position data structure containing data representing at least one starting field position for the game, (ii) a defense data structure containing data representing at least one defensive formation for defensive players for the game, (iii) an offense data structure containing data representing at least one offensive formation for offensive players for the game, and (iv) a play data structure containing data representing, for combinations of defensive and offensive formations, winning and losing play outcomes;

the player making a wager and initiating play of the game;

said processor selecting from the field data structure a starting field position for the game and from the defensive data structure a defensive formation and displaying said starting field position and said defensive formation at said starting position;

the player selecting from the offense data structure an offense and displaying at said display opposite the defensive formation at the starting field position the offensive formation selected from the offense data structure;

said player prompting the processor to complete the play whereupon said processor, from the play data structure, randomly selecting and displaying a play outcome;

if the selected outcome is a winning play outcome rewarding the player based upon said wager.

2. The method of claim 1 including providing said processor with a starting field position data structure containing data representing a plurality starting field positions for the game and said processor randomly selecting from the starting field data structure and displaying said starting field position.

3. The method of claim 1 including providing said processor with a defense data structure containing data representing a plurality of defensive formations for defensive players for the game and said processor randomly selecting from the defensive data structure and displaying said defensive player formation.

4. The method of claim 1 including providing a processor with an offense data structure containing data representing a plurality of offensive formations for offensive players for the game.

5. The method of claim 4 including providing a processor with an offense data structure containing data representing a plurality of offensive formations for offensive players for the game including a run formation a pass formation and a field goal formation and said processor, (i) in response to selection of a run formation selects from the play data structure a running play outcome, (ii) in response to selection of a pass formation selects from the play data structure a passing play outcome, and (iii) in response to selection of a field goal formation selects from the play data structure a field goal play outcome.

6. The method of claim 5 including providing a processor with a play data structure containing data representing, for combinations of defensive and offensive formations, winning and losing play outcomes wherein said winning play outcomes include the outcomes of Table 1

TABLE 1

| Winning Outcome | |
|---|---|
| Touchdown 50 yards and over | Field Goal 30–59 yards |
| Touchdown of 40–49 yards | Gain of 30 yards or more |
| Touchdown of 30–39 yards | Gain of 20–39 yards |
| Field Goal 60 yards and over | First down |
| Field Goal 30–59 yards. | |

7. The method of claim 6 including statistically weighing the winning and losing play outcomes and rewards to provide a payoff frequency of at least 80 percent.

8. The method of claim 1 further including said player after display of the outcome, opting to make an additional wager, said processor in response to selection of said option, (i) displaying the field position of said outcome and (ii) selecting from said defense data structure a defensive formation;

said player selecting from the offense data structure an offense and displaying at said display opposite the defensive formation at the starting field position the offensive arrangement selected from the offense data structure;

said player prompting the processor to complete the play whereupon said processor, from the play data structure, randomly selecting and displaying a second play outcome;

if the selected second play outcome is a winning play outcome rewarding the player based upon said wager.

9. A method for playing a wagering football game comprising:

the player making a wager and initiating play of the game:

displaying a representation of a football playing field;

selecting a starting field position and displaying the same at the representation of the playing field;

presenting a defensive formation representing at said starting field position;

the player selecting from a library of football offenses a selected offensive formation and displaying the selected offensive formation positioned against the displayed defensive formation;

the player prompting completing of the play whereupon, based upon the defensive and offensive formations are selected from a plurality of outcomes including losing and winning outcomes; and if a winning outcome is obtain rewarding the player based upon the outcome.

* * * * *